United States Patent [19]

Kinn et al.

[11] Patent Number: 4,715,564

[45] Date of Patent: Dec. 29, 1987

[54] CHEMILUMINESCENT KITE

[76] Inventors: John J. Kinn; Donna A. Kinn, 17 Peregrine Dr., Voorhees, N.J. 08043

[21] Appl. No.: 822,362

[22] Filed: Jan. 24, 1986

[51] Int. Cl.[4] ..... B64C 31/06

[52] U.S. Cl. ..... 244/153 R; 446/219; 446/30; 244/155 R

[58] Field of Search ..... 244/153 R, 155 R, 153 A, 244/154, 155 A; D21/88; 446/30, 34, 46, 47, 175, 219; 40/591, 592; 362/34; 116/209, 63 P, 206

[56] References Cited

U.S. PATENT DOCUMENTS

| | | | |
|---|---|---|---|
| D. 149,001 | 3/1948 | Lang . | |
| D. 149,002 | 3/1948 | Lang . | |
| D. 169,291 | 4/1953 | Spanvill . | |
| D. 212,017 | 8/1968 | Kennedy . | |
| D. 222,838 | 1/1972 | Ferguson . | |
| D. 253,417 | 11/1979 | Infante . | |
| D. 253,833 | 1/1980 | Miller . | |
| 800,926 | 10/1905 | Mahony . | |
| 800,927 | 10/1905 | Mahony . | |
| 1,326,434 | 12/1919 | Bergher . | |
| 1,821,465 | 9/1931 | Dysert | 244/153 R |
| 2,394,366 | 2/1946 | Chu et al. . | |
| 2,419,441 | 4/1947 | De Roda . | |
| 2,431,938 | 12/1947 | Jalbert . | |
| 2,488,118 | 11/1949 | Cobb et al. . | |
| 2,494,430 | 1/1950 | Carnwath | 244/153 A |
| 2,632,614 | 3/1953 | Bodell | 244/153 R |
| 2,733,880 | 2/1956 | Burrell et al. . | |
| 3,194,521 | 7/1965 | Rider et al. . | |
| 3,362,378 | 1/1968 | Bens . | |
| 3,377,291 | 4/1968 | Winberg . | |
| 3,392,123 | 7/1968 | Winberg . | |
| 3,539,794 | 10/1970 | Rauhut et al. . | |
| 3,576,987 | 5/1971 | Voight et al. . | |
| 3,597,362 | 8/1971 | Bollyky et al. . | |
| 3,732,413 | 5/1973 | Shefler et al. . | |
| 3,751,846 | 8/1973 | Benjamin, Sr. . | |
| 3,868,630 | 2/1975 | Lesondak | 116/63 P |
| 3,938,465 | 2/1976 | Lyons | 116/209 |
| 4,064,428 | 12/1977 | Van Zandt . | |
| 4,086,723 | 5/1978 | Strawick | 273/424 |
| 4,106,079 | 8/1978 | Drury | 362/34 |
| 4,186,426 | 1/1980 | Gingras, Sr. et al. | 116/63 P |
| 4,193,222 | 3/1980 | Deschand . | |
| 4,204,357 | 5/1980 | Harrington . | |
| 4,254,575 | 3/1981 | Gould . | |
| 4,379,320 | 4/1983 | Mohan et al. . | |

*Primary Examiner*—Galen Barefoot
*Attorney, Agent, or Firm*—Wegner & Bretschneider

[57] ABSTRACT

A chemiluminescent kite has a frame including at least one support member, and a cover sheet supported by the frame and adapted to catch the wind. At least one support member of the kite includes at least one self-contained source of chemiluminescent light. The source has an outer flexible container which transmits light and which contains both a first reactive composition and at least one inner breakable container. The inner container contains a second reactive composition which is adapted to react with the first reactive composition to provide chemiluminescent light. The cover sheet may be made of a translucent or transparent material so that the light is visible through the cover sheet. In addition, the cover sheet may be decorated with an opaque design.

15 Claims, 9 Drawing Figures

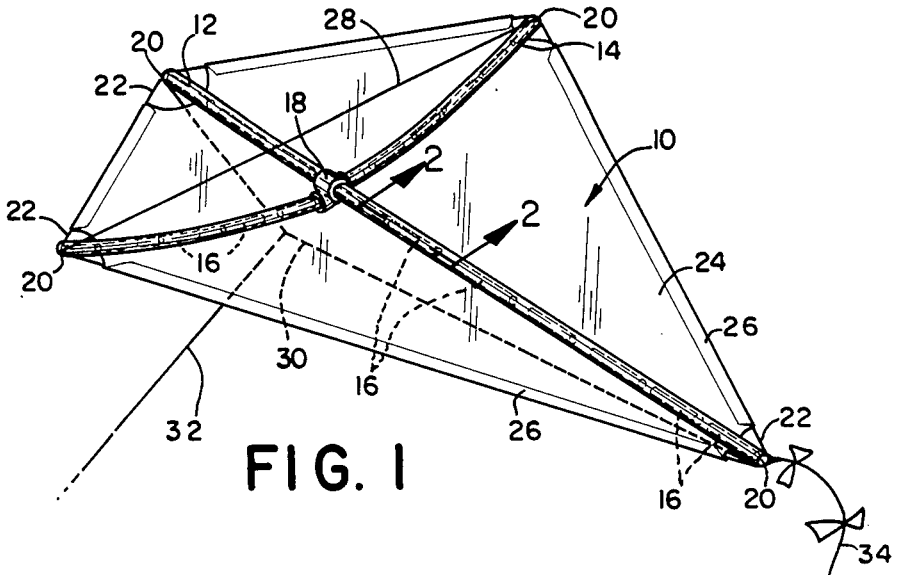
FIG. 1
FIG. 3
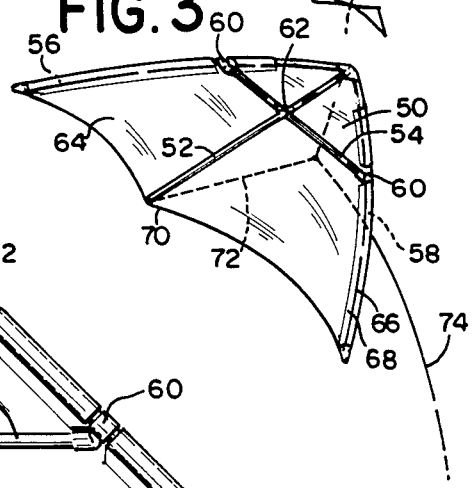
FIG.4
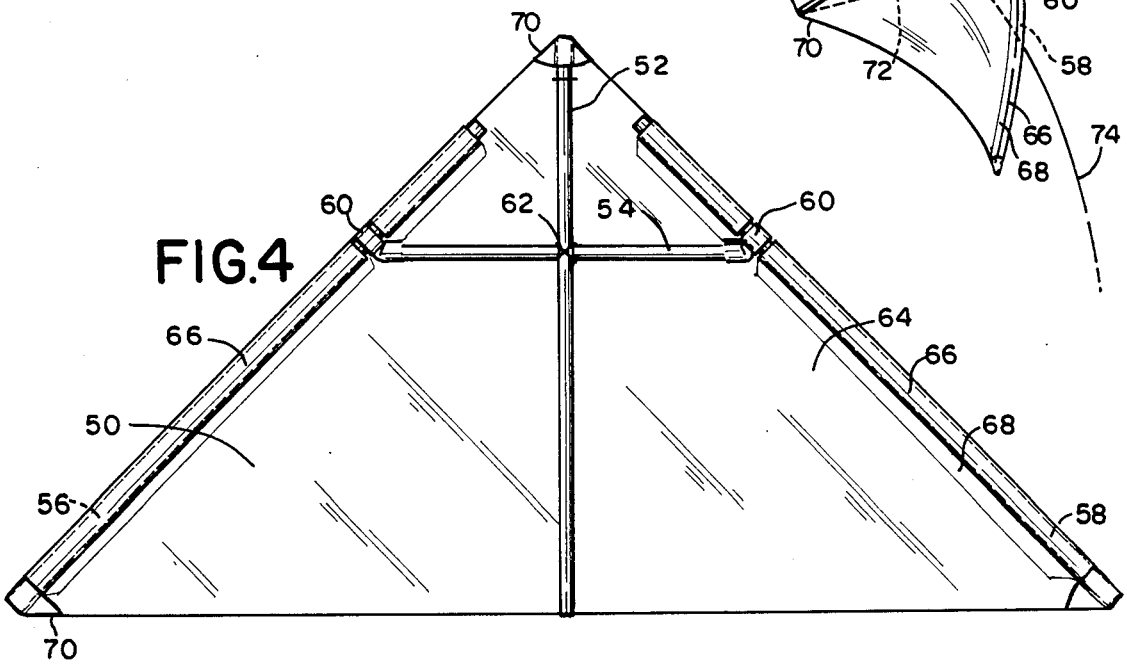
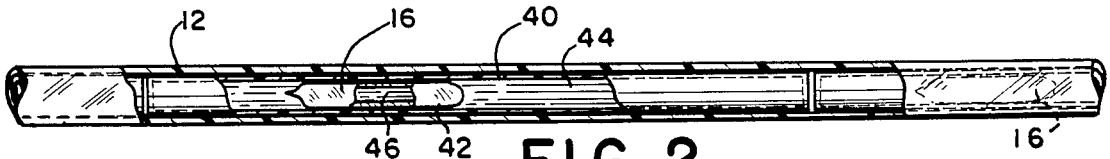
FIG. 2

CHEMILUMINESCENT KITE

BACKGROUND OF THE INVENTION

1. Field of the Invention

This invention relates to kites. More particularly, this invention relates to novel chemiluminescent kites adapted to be flown in the air at night or under otherwise darkened conditions.

2. Description of the Prior Art

Kites are familiar toys. They are available in a multitude of designs having a variety of structures and formed from various materials. Most kites may only be flown during the day; they cannot be easily seen in the night sky. There is a need for an illuminated kite which can be easily recognized when flown at night or when visibility is poor for recreational use or for advertising purposes.

Devices for providing chemiluminescent light typically employ a pair of compositions which react chemically to excite a compound which fluoresces in response. A chemiluminescent light source may be a self-contained unit, such as that disclosed in U.S. Pat. No. 3,576,397, in which an outer flexible, cylindrical, light transmitting container for one reactive composition, and an inner, rigid container for another reactive composition are provided. Flexing the outer container through an arc with a sufficiently small radius breaks the inner container, allowing the reactive compositions to mix. The two compositions react chemically to excite a material which fluoresces and produces chemiluminescent light. The light is visible through the outer light transmitting container. The fluorescent material is dissolved in either the first or the second reactive composition or in both.

Self-contained chemiluminescent light sources of this type are available from American Cyanamid Company under the trademark CYALUME. Similar chemiluminescent light sources are described in U.S. Pat. Nos. 4,064,428 and 4,379,320. Self-contained chemiluminescent light sources may generate light by the reaction of oxalic acid derivatives with hydroperoxides in the presence of a solvent and a fluorescent compound such as disclosed in U.S. Pat. No. 3,597,362. Another source of chemiluminescence, chemiluminescent peraminoethylene compounds, is disclosed in U.S. Pat. No. 3,362,378, and related formulations are disclosed in U.S. Pat. Nos. 3,392,123 and 3,377,291; related light producing devices are disclosed in U.S. Pat. No. 3,732,413.

The use of a chemiluminescent light source to illuminate a plastic saucer toy for use at night is described in U.S. Pat. No. 4,086,723. The light source is clipped to the bottom of the saucer. U.S. Pat. No. 4,254,575 discloses a system for illuminating a saucer toy for use at night by insertion of a chemiluminescent device bent into a hoop through the underside of the toy to fit against the inner rim of the saucer.

An audible and luminous swingable toy employing a self-contained chemiluminescent light source is disclosed in U.S. Pat. No. 4,193,222. Chemiluminescent light sources are also used to illuminate balls and decorative bracelets and necklaces.

A kite simulating a flying saucer and illuminated by an incandescent bulb is disclosed in U.S. Pat. No. 2,632,614. Life saving apparatus using a lantern suspended from a kite is disclosed in U.S. Pat. Nos. 800,926 and 800,927. U.S. Pat. No. 1,326,434 discloses a military kite carrying signal lamps and search lights.

Kite flying is an art which requires that the kite flyer sense and act on changes in the wind, and the effects of wind change on the kite. This information comes mostly from observation of the kite. The ability to observe the kite declines with declining light. Observation of kites illuminated with point sources of light does not reveal as much about wind conditions as does observation of kites flown in daylight. There is a need for an illuminated kite which conveys more information about wind conditions to the kite flyer than do kites illuminated with point sources.

Further, prior art illuminated kites require a source of electrical energy, such as batteries, which provide limited power per unit of additional weight which the kite must carry. The battery must be placed carefully so that the aerodynamic characteristics of the kite are not significantly altered. This constraint limits the range of kite designs which may be illuminated by electricity.

The present invention provides illuminated kites which may be observed at night or under darkened conditions. These kites are illuminated by chemiluminescent light. Sources of chemiluminescent light are not point sources of light, but rather are extended in space. The source or sources of the chemiluminescent light illuminate the kite so that observation of the night flying kite tells the kite flyer more about wind conditions than do kites of similar design illuminated with point sources of light, such as incandescent lamps.

SUMMARY OF THE INVENTION

The present invention provides a chemiluminescent kite which comprises a frame including at least one support member; a cover sheet supported by the frame and adapted to catch the wind; and a self-contained source for providing chemiluminescent light, the source having an outer flexible light transmitting container which contains a first reactive composition, the source also having at least on inner breakable container within the outer container, the inner container containing a second reactive composition adapted to react with the first reactive composition to provide chemiluminescent light; wherein at least one support member comprises at least one self-contained chemiluminescent light source. The cover sheet may be made of a material selected from transparent and translucent materials.

In one aspect the present invention provides a chemiluminescent kite in which at least one support member comprises a substantially rigid tube containing at least one self-contained chemiluminescent light source.

In another aspect the present invention provides a chemiluminescent kite wherein at least one support member is a chemiluminescent light source having a single outer container extending the length of light source and having a plurality of inner containers disposed within the outer container, the outer container containing a first reactive composition, and each inner container containing a second reactive composition.

BRIEF DESCRIPTION OF THE DRAWINGS

For the purpose of illustrating the invention, there are shown in the drawings forms which are presently preferred; it being understood, however, that this invention is not limited to the precise arrangements and instrumentalities shown.

FIG. 1 is a perspective view of one embodiment of a chemiluminescent kite according to the present invention having a generally diamond shape, and shown in a generally horizontal orientation as it is being flown.

FIG. 2 is a partial cross-sectional view of the embodiment of the chemiluminescent kite shown in FIG. 1 taken along line 2—2 in FIG. 1.

FIG. 3 is a top perspective view of another embodiment of a generally delta-shaped chemiluminescent kite according to the present invention viewed from above as it is being flown.

FIG. 4 is a plan view of the generally delta-shaped kite according to the present invention illustrated in FIG. 3.

DETAILED DESCRIPTION

Figure 5:
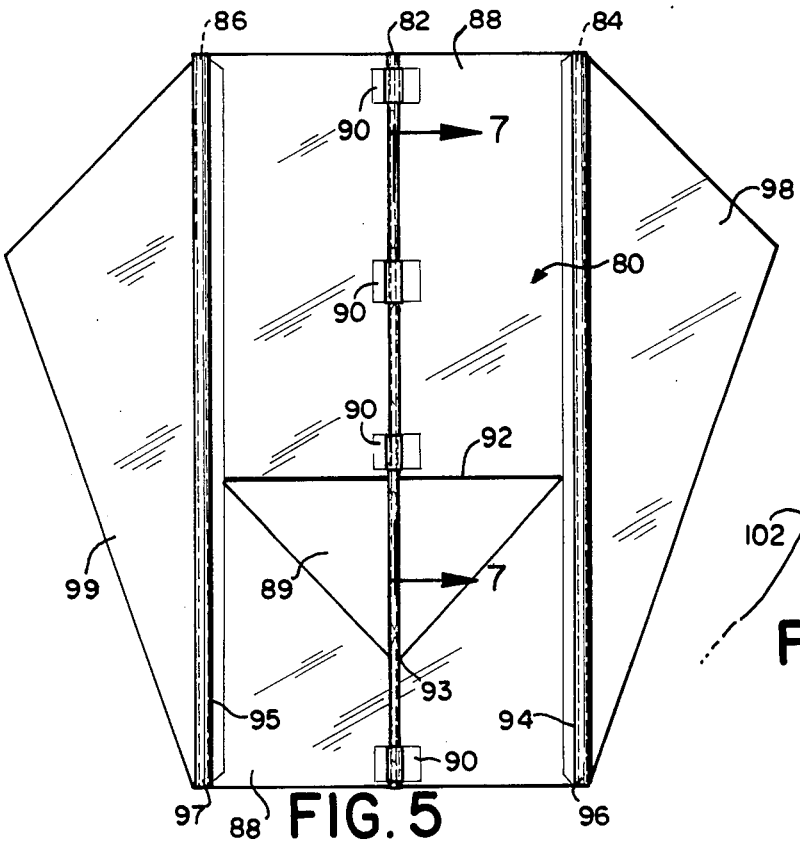
FIG. 5 is a plan view of one embodiment of a barrel kite according to the present invention in a generally flat orientation prior to being launched.

Kites according to the present invention may assume any of a great variety of shapes and structural designs, as exemplified below. For example, box kites, delta-shaped kites, diamond-shaped kites, tailless Malay kites, rectangular kites, snake kites, sled kites, snub nose head kites, double bow kites, and the like, may be constructed to provide kites according to the present invention.

In one aspect the present invention provides a chemiluminescent kite in which at least one of the support members of the kite frame comprises a substantially rigid tube containing at least one chemiluminescent light source. The support member tube may be cylindrical and the inner diameter of the cylindrical tube may be adapted to receive and slidingly engage in a friction fit the cylindrical outer container of a chemiluminescent light source.

Preferably, the cross-sectional shape of the support member tube is selected so that the outer container of a chemiluminescent light source may be received into the tube in sliding engagement with at least one interior surface of the support member tube. The cross-sectional shape and interior dimensions of the support member tube are preferably selected so that the light source is retained in position by a friction fit. Advantageously, fresh light sources are thus easily placed within the tube and spent light sources are easily removed from the tube. While the kite is being flown, the light sources are also thus retained in the positions in which they have been placed. The chemiluminescent light sources may be retained securely within the support member tube by removable tube closure means, such as press fit caps.

The support member tube is preferably transparent or translucent, at least proximate the chemiluminescent light source, so that the light from the light source may be observed through the tube. The tube may be made from a material containing a compound which fluoresces in response to the light emitted by the chemiluminescent light source (secondary fluorescer), such as disclosed in U.S. Pat. No. 4,379,320. The secondary fluorescer may be homogeneously distributed in the material from which the support tube is formed; or the distribution of the secondary fluorescer within the tube may vary, so as to form a design, such as annular rings spaced longitudinally along the tube.

The substantially rigid tube may contain a single chemiluminescent light source; alternatively, the tube may contain a plurality of chemiluminescent light sources. Depending on the design of the kite, the frame may comprise a plurality of support members. Chemiluminescent light sources may be contained within any or all of the support members of the frame. The chemiluminescent light sources may extend substantially the length of a support member. Alternatively, the chemiluminescent light sources may be spaced along the length of the support member. The spacing may be selected so that the spaced chemiluminescent light sources contained within a single support member or several support members form a pattern or design.

A support member comprising a chemiluminescent light source may comprise a tubular member and at least one self-contained chemiluminescent light source secured to the exterior of the tubular member by connector means, such as single or plural clips, a second tubular member, elastic bands, or the like.

Another aspect of the present invention provides a chemiluminescent kite wherein at least one support member is itself a chemiluminescent light source. In this aspect, a support member which is a light source has a single outer container extending the length of the light source. The outer container has a plurality of inner containers disposed within the outer container, and contains a first reactive composition as well. Each of the inner containers contains a second reactive composition adapted to react with the first reactive composition.

As indicated above, depending on the structural design of the kite, the kite may have a single support member or a plurality of support members. In the case of a kite having a plurality of support members, any one of the support members may be a chemiluminescent light source, or all of the support members may be chemiluminescent light sources.

Kites according to the present invention may have both one or more support members which are themselves chemiluminescent light sources and one or more support member tubes which contain chemiluminsecent light sources.

When a chemiluminescent light source is used as a support member, the outer container of the light source must be sufficiently flexible to permit the rupture of the inner breakable containers contained within the single outer container of the support member. However, the outer container of the support member must also be sufficiently rigid so that the frame adequately supports the cover sheet, permitting the kite to be flown. As will be apparent to those skilled in the art, the rigidity required of the outer container depends on the structural design of the kite.

In another aspect the present invention provides a chemiluminescent kite comprising at least one chemiluminescent light source which emits light having a color which differs from the color of the light emitted by at least one other chemiluminescent light source comprising the kite.

Figure 6:
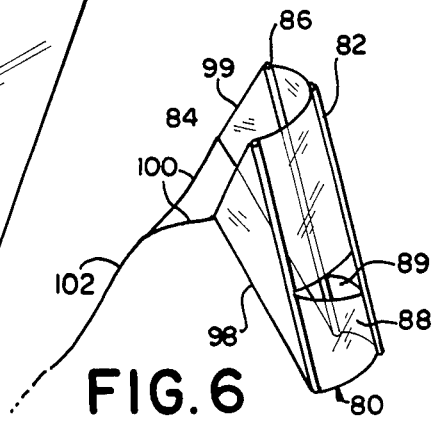
FIG. 6 is a side perspective view of the embodiment of the sled kite illustrated in FIG. 5 shown while being flown.
Figure 7:
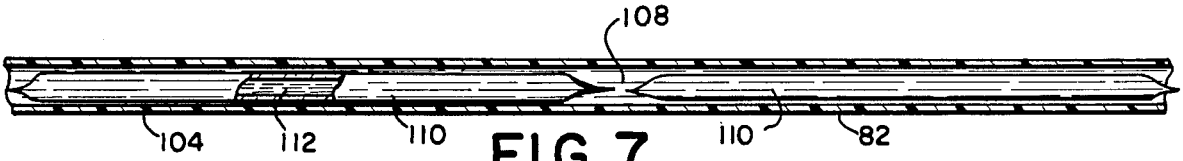
FIG. 7 is a partial cross-sectional view of the embodiment of a support member comprising the central strut of the sled kite illustrated in FIGS. 5 and 6 taken along line 7—7 in FIG. 5.
Figure 8:
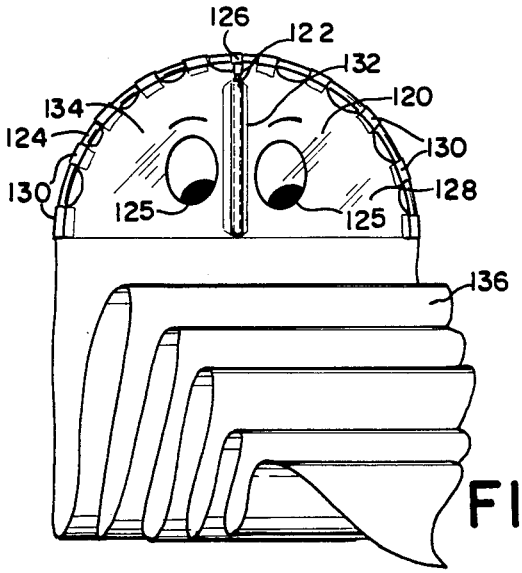
FIG. 8 is a perspective view of one embodiment of a snake kite according to the present invention in a generally horizontal orientation prior to being launched.
Figure 9:
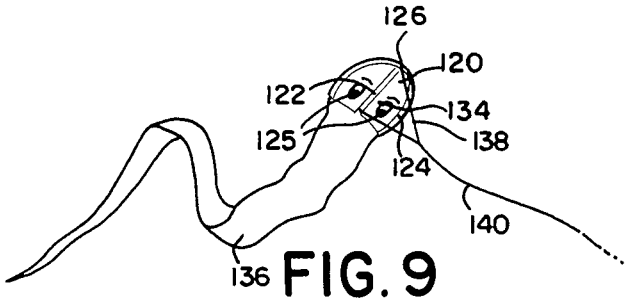
FIG. 9 is a side perspective view of the embodiment of the snake kite shown in FIG. 8 and illustrated as it is being flown.

Depending on the structural design of the kite, support members comprising chemiluminescent light sources may be positioned either in front of or in back of the cover sheet of the kite, or both. The front of the cover sheet of the kite is that side of the cover sheet which faces into the wind. Examples of chemiluminescent kites having at least one support member comprising a chemiluminescent light source which is positioned in back of the cover sheet are given below by the presently preferred embodiments of a diamond kite (FIGS. 1 and 2), a delta kite (FIGS. 3 and 4), and a snake kite (FIGS. 8 and 9). An example of a chemiluminescent kite having at least one support member comprising a chemiluminescent light source which is positioned in front of the cover sheet is given below by the presently preferred embodiment of a sled kite (FIGS. 5–7).

Preferably, the cover sheet is selected to permit the chemiluminescent light of the kite to be viewed by the kite flyer as the kite is being flown. As will be evident to those skilled in the art, this can be accomplished in a variety of ways. For example, the cover sheet of the kite may be made of a transparent or translucent material. Alternatively, the kite design can be selected to permit at least portions of the chemiluminescent light source to be visible to the observer, through cut-away sections of the cover sheet, illuminated support members which extend beyond the cover sheet, or the like.

The cover sheet may be made of a material containing a fluorescent or phosphorescent compound, or decorated with ink, coating fabric, material, or the like, containing a fluorescent or phophorescent compound. The fluorescent compound may be a secondary fluorescer, responsive to the chemiluminescent light emitted by the chemiluminescent light source, as disclosed in U.S. Pat. No. 4,379,320.

The cover sheet of the chemiluminescent kite may be decorated, as with a colored design. The chemiluminescent kite may have a cover sheet which is transparent or translucent and the cover sheet may bear an opaque design. In another aspect, an illum nated kite according to the present invention may have a transparent cover sheet bearing a translucent design.

Alternatively, when the cover sheet is transparent, a translucent design or a design having both translucent and opaque elements may decorate the cover sheet. The design may be formed from a coating containing a fluorescent compound. The fluorescent compound may be a secondary fluorescer.

The cover sheet may be made from a film of a thermoplastic material such as polyethylene, a translucent fabric, a translucent paper such as rice paper or glazed paper, or the like. As will be recognized by those skilled in the art, the choice of a particular material for the cover sheet is affected by the structural design of the kite. Cover sheets made from materials which are transparent or translucent are preferred. Preferably, the cover sheet is transparent or translucent at least in the vicinity of the chemiluminescent light sources carried by the kite.

Depending on the structure of the kite, the cover sheet may be cut away in the vicinity of the chemiluminescent light source. The cut-away portion of the cover sheet permits the chemiluminescent light source to be viewed from below while the kite is being flown when the cover sheet is opaque in the vicinity of the light source. A cut-away portion of the cover sheet may also make up a part of the kite design, structure, or both.

Depending on the structure of the kite, the support members comprising the frame of the kite may be secured only to the cover sheet. In the alternative, at least one support member may be secured to at least one other support member. A support member secured to another support member may be also secured to the cover sheet of the kite.

Support members may be secured to one another by binding with thread, twine, elastic bands or the like; or by a fastening member or connector adapted to secure one support member to another support member, such as a clip, clamp, or the like. The support members may be rigidly secured to one another as by clamping, clipping, or by adhesive bonding or heat sealing, in the case of support members formed from thermoplastic materials adapted for thermofusion bonding. When a support member is itself a chemiluminescent light source, it is preferred that the support member be removably secured so that spent light sources may be replaced with fresh light sources.

The support members may be rigidly or loosely secured to the cover sheet of the kite. For example, the support members may be slideably secured within pockets formed along the edges of the cover sheet. Alternatively, when both the cover sheet and the support member are made from thermoplastic materials adapted for thermofusion bonding, the cover sheet may be secured to the support member of the frame by a thermofusion bonding technique, such as heat sealing or ultrasonic welding.

Referring now to the drawings in detail where like-referenced characters indicate like elements, there is shown in FIG. 1 a perspective view of a diamond kite 10 of a presently preferred embodiment of the present invention. The diamond kite 10 has a symmetric diamond shape and a frame comprising a pair of substantially rigid and generally tubular support members. The two support members are a central strut 12, which is oriented to bisect the diamond kite 10, and a cross strut 14 which is secured perpendicularly to the central strut 12 by a connector 18. As illustrated in FIG. 1, both the central strut 12 and the cross strut 14 are formed from cylindrical, tubular stock. The support members illustrated in FIG. 1 are transparent; however, the central strut 12 and cross strut 14 may also be translucent.

The transparent cylindrical central strut 12 and cross strut 14 support members of the kite frame each contain a plurality of light sources 16. These generally cylindrical light sources 16 are self-contained sources for providing chemiluminescent light. The light sources 16 are secured within the generally tubular central strut 12 and cross strut 14 by a friction fit.

Each of the ends of both the central strut 12 and the cross strut 14 has a notch 20 which is adapted to receive a perimeter line 22. The perimeter line may be string, wire, monofilament, or the like. The perimeter line 22 is the part of the kite frame to which a cover sheet 24 is secured.

The cover sheet 24 shown in FIG. 1 is made from a transparent material, such as a transparent polyethylene film or sheet. Alternatively, a translucent cover sheet may be used. Extending substantially along the edges of the cover sheet 24 between the ends of the central strut and cross strut 14 are flaps or pockets 26 within which the perimeter line 22 is contained. The flaps 26 are formed by folding the edges of the cover sheet 24 over the perimeter line 22 and adhesively bonding the contacting surfaces of the cover sheet 24.

A bow line 28 is provided to maintain tension on the substantially rigid tubular cross strut 14. The diamond kite 10 also includes a bridle 30 positioned on the side of the cover sheet 24 opposite the support members and secured at either end of the central strut 12. To the bridle 30 is secured a guide line 32 with which the diamond kite 10 may be flown. The diamond kite 10 also includes a tail 34 secured to the end of the central strut 12 furthest removed from the cross strut 14 to stabilize the diamond kite 10 when flown.

FIG. 2 illustrates a partial sectional view of the central strut 12 taken along the line 2—2 in FIG. 1. As illustrated in FIG. 2 the central strut 12 contains cylindrical light sources 16 which are secured within the central strut 12 by friction fit. The light sources 16 are self-contained sources for providing chemiluminescent light and have a generally cylindrical outer container 40 which is both flexible and light transmitting. The outer container 40 contains a first fluid 44 or first reactive composition. The outer container 40 also contains an inner container 42 which is breakable. The inner container 42 contains a second fluid 46 or second reactive composition. When the outer container 40 of the light source 16 is flexed through an arc with a sufficiently small radius, the inner container 42 is ruptured, thereby permitting the first fluid 44 and second fluid 46 to mix and chemically react.

The light sources 16 are spaced within central strut 16. The light sources 16 are positioned within the central strut 12 so that the ends of the light sources 16 are in close proximity as shown in FIG. 2, thus maximizing the chemiluminescent light provided from this central strut 12. Alternatively, the light sources 16 may be spaced apart within the central strut 12.

The chemiluminescent reaction may be initiated by flexing the light sources 16 prior to placing them within the central strut 12 and cross strut 14 before the diamond kite 10 is launched. Preferably, rupture of the inner containers 42 is delayed until immediately prior to launching the kite, so that the light sources 16 will provide chemiluminescent light for as long as possible during flight.

Alternatively, the light sources 16 may be inserted into the central strut 12 and cross strut 14 before the inner containers 42 of the light sources 16 are broken. For example, the struts 12, 14 containing the light sources 16 may be provided or preassembled units. However, in this case, the substantially rigid tubes from which the central strut 12 and cross strut 14 are formed must be sufficiently flexible to permit the inner containers 42 of the light sources to be ruptured by bending both the struts 12, 14 and the light sources 16 contained therein. Nevertheless, the tubes must be sufficiently rigid to support the cover sheet of the kite during flight.

The chemiluminescent light produced by the reaction of the first fluid 44 and second fluid 46 within the light source 16 may be viewed through the transparent central strut 12 and cross strut 14. Further, the chemiluminescent light is visible through the transparent cover sheet 24.

There is illustrated in FIGS. 3 and 4 a delta kite 50 of a second presently preferred embodiment of the present invention. FIG. 3 is a perspective view of a generally delta-shaped illuminated kite 50 viewed from above as it is being flown. FIG. 4 is a plan view of the delta kite 50 illustrated in FIG. 3.

The frame of the delta kite 50 comprises several support members. The support members are a central strut 52, which is secured to a cross strut 54 by a strut tie 62 formed from string. Alternatively, the strut tie 62 may be an elastic band; or a connector member such as a clip (not illustrated) may be used to secure the central strut 52 to the cross strut 54. Either end of the cross strut 54 is secured by a strut connector 60 to one of two side struts 56, 58. Each of the struts 52, 54, 56, 58 is a substantially rigid, translucent cylindrical tube adapted to receive generally cylindrical chemiluminescent light sources (not illustrated) with a loose friction fit.

The cover sheet 64 is secured to the frame to the delta kite 50 by flaps or pockets 66 which are formed on the side edges of the cover sheet 64 by folding portions of the side edges of the cover sheet 64 and heat sealing a portion of the contacting area thus forming lap seals 68. The side struts 56, 58 are substantially contained within the pockets 66. One end of the central strut 52 is positioned within a center pocket 70 formed at one tip of the cover sheet 64 of the delta kite 50. The pockets 66 are cut away in the vicinity of the connectors 60 to permit the connectors 60 to join the cross strut 54 with the side struts 56, 58.

The cover sheet 64 is made from a transparent thermoplastic material. As shown in FIG. 3, a generally triangular bridle flap 72 is attached to and bisects the generally triangular cover sheet 64. The bridle flap 72 is made from the same material as the cover sheet 64. The delta kite 50 is flown with a guideline 74 attached to the bridle flap 72.

FIGS. 5, 6 and 7 illustrate a sled kite 80 of a third presently preferred embodiment according to the present invention. FIG. 5 is a plan view of sled kite 80 in a generally horizontal orientation prior to being launched. FIG. 6 is a side perspective view of the sled kite 80 illustrated in FIG. 5 shown while it is being flown. The frame of the sled kite 80 comprises three support members which are not connected to one another except indirectly through a cover sheet 88. The support members are a central strut 82 and two side struts 84, 86.

The cover sheet 88 has a generally triangular hole 89 located in the lower portion of the cover sheet 88. The triangular hole 89 has a base 92 and a central apex 93 opposite the base 92 and a generally isosceles shape. The hole 89 is positioned so that the base 92 of the triangular hole 89 is perpendicular to the central strut 82 and spans the width of the cover sheet 88 from proximate one side strut 84 to proximate the other side strut 86. The apex 93 of the triangular hole 89 opposite the base 92 of the triangular hole 89 is centered on the cover sheet 88. The apex 93 is positioned below the base 92 of the triangular hole 89.

The long sides of the generally rectangular cover sheet 88 are folded over on to themselves and sewn along stitch lines 94, 95 paralleling the sides of the cover sheet 88 to form pockets 96, 97 adapted to receive the side struts 84, 86. The stitch lines 94, 95 also secure a pair of generally triangular bridle flaps 98, 99 to the cover sheet 88.

A plurality of tabs 90 are sewn onto the cover sheet 88 and are adapted to secure the central strut 82 to the cover sheet 88.

The cover sheet 88, bridle flaps 98, 99, and the tabs 90, are manufactured from a translucent fabric. As illustrated in FIG. 6, the sled kite 80 is flown with a guideline 102, the end of which is attached to the ends of a pair of bridle lines 100, which are in turn secured to the bridle flaps 98, 99.

As illustrated in FIG. 7, which is a partial cross-sectional view of the sled kite 80 illustrated in FIGS. 5 and 6 taken along line 7—7 in FIG. 5, the central strut 82 is a chemiluminescent light source. The tubular, generally cylindrical outer container 104 of the central strut 82 is sealed at either end. The outer container 104 contains a first reactive fluid 108 and a plurality of sealed, generally tubular, breakable inner containers 110 spaced along the length of the central strut 82. The inner containers 110 contain a second reactive fluid 112 which is adapted to react chemically with the first fluid 108 to yield chemiluminescent light.

The outer container 104 is substantially rigid; that is, it is suffiently rigid to support the sled kite 80 as it is being flown. However, the outer container 104 is also sufficiently flexible so that it may be flexed into an arc with a sufficiently small radius so that the breakable inner containers 110 contained within the outer container 104 will be broken when the central strut is bent in an arc having a sufficiently small radius. The inner containers 110 are broken by bending the central strut 82 prior to launching the sled kite 80.

FIGS. 8 and 9 illustrate a snake kite 120 of yet another presently preferred embodiment according to the present invention. FIG. 8 is a perspective view of the snake kite 120 in a generally horizontal orientation prior to being launched. FIG. 9 is a side perspective view of a snake kite 20 shown in FIG. 8 and illustrated as it is being flown. As shown in FIG. 8 the frame of the snake kite comprises a pair of support members. The frame comprises a central strut 122 which is secured at one end of the central strut 122 by connector 126 to an outside strut 124 at the midpoint of the outside strut 124.

The cover sheet 128 of the snake kite 120 comprises a head 134 made from a transparent thermoplastic material and which is joined to a tail 136 made from a translucent thermoplastic material. The head 134 of the cover sheet 128 is secured to the support members of the frame of the snake kite 120 by a plurality of tabs 130, which secure the outside strut 124 to the head 134 of the cover sheet 124, and by a flap or pocket 132 which secures the central strut 122 to the head 134 of the cover sheet 124.

The cover sheet 128 is decorated with an opaque design 125, a pair of eyes. The eye design 125 is printed on the cover sheet 128.

Both the central strut 122 and the outside strut 124 are translucent, tubular, and contain a plurality of self-contained cylindrical chemiluminescent light sources (not shown) such as illustrated in FIG. 2. Prior to the launching of the snake kite 120, cylindrical self-contained chemiluminescent light sources (not shown) are activated by flexing to break the inner containers contained within the chemiluminescent light sources and placed within the tubular central strut 122 and outside strut 124.

As illustrated in FIG. 9, the kite is flown by a guideline 140 which is secured to a bridle 138. The ends of the bridle 138 are attached to the central strut 122 of the frame at points near the top and bottom ends of the central strut 122.

The present invention may be embodied in other specific forms without departing from the spirit or the essential attributes thereof and, accordingly, reference should be made to the appended claims, rather than to the foregoing specification as indicating the scope of the invention.

We claim:

1. A chemiluminescent kite comprising a cover sheet for providing aerodynamic lift, a frame comprising a plurality of support members, said support members providing support for said cover sheet, and attachment means for connecting said cover sheet to said support members, wherein at least one of said support members is a light transmitting container adapted to hold therein a source of chemiluminescent light.

2. A chemiluminescent kite according to claim 1, wherein said attachment means is a plurality of receptacles formed from said cover sheet to receive said support members.

3. A chemiluminescent kite according to claim 1, wherein said attachment means is a thermofusion bond between said cover sheet and said support members.

4. A chemiluminescent kite according to claim 1, wherein said chemiluminescent light source consists of a first reactive composition and a second reactive composition adapted to react with the first reactive composition to produce chemiluminescent light and said reactive compositions are in direct contact with said light transmitting container.

5. A chemiluminescent kite according to claim 1, wherein said chemiluminescent light source consists of at least one removable, light transmitting container which contains both a first reactive composition and a second reactive composition adapted to react with the first reactive composition to produce chemiluminescent light.

6. A chemiluminescent kite according to claim 1, wherein said chemiluminescent light source consists of a plurality of removable, light transmitting containers each of which contains both a first reactive composition and a second reactive composition adapted to react with the first reactive composition to produce chemiluminescent light.

7. A chemiluminescent kite according to claim 1, wherein a plurality of said support members are light transmitting containers and are adapted to hold therein a source of chemiluminescent light.

8. A chemiluminescent kite according to claim 7, wherein at least one of said light transmitting containers emits light having a color which differs from the color of the light emitted by at least one other of said light transmitting containers.

9. A chemiluminescent kite according to claim 1 wherein the cover sheet is made of a material selected from transparent and translucent materials.

10. A chemiluminescent kite according to claim 1 wherein at least one support member is cylindrical.

11. A chemiluminescent kite according to claim 1 wherein the cover sheet bears a colored design.

12. A chemiluminescent kite according to claim 11 wherein the colored design is formed from a coating containing a fluorescent compound.

13. A chemiluminescent kite according to claim 9 wherein the cover sheet bears an opaque design.

14. A chemiluminescent kite according to claim 9 having a transparent cover sheet bearing a translucent design.

15. A chemiluminescent kite according to claim 1 wherein the cover sheet is made from a material containing a fluorescent compound.

* * * * *